US009821367B2

(12) United States Patent
Huesgen et al.

(10) Patent No.: US 9,821,367 B2
(45) Date of Patent: Nov. 21, 2017

(54) FOUR-DIE TOOL AND FORGING PRESS

(71) Applicants: David Huesgen, Meerbusch (DE); Guenter Josef Panzer, Niederkruechten (DE)

(72) Inventors: David Huesgen, Meerbusch (DE); Guenter Josef Panzer, Niederkruechten (DE)

(73) Assignee: SMS MEER GMBH, Moenchengladbach (DE)

( * ) Notice: Subject to any disclaimer, the term of this patent is extended or adjusted under 35 U.S.C. 154(b) by 106 days.

(21) Appl. No.: 14/308,337

(22) Filed: Jun. 18, 2014

(65) Prior Publication Data

US 2015/0013424 A1 Jan. 15, 2015

(30) Foreign Application Priority Data

Jun. 24, 2013 (DE) ..... 10 2013 211 895
Jun. 18, 2014 (DE) ..... 10 2014 211 773

(51) Int. Cl.
*B21J 9/06* (2006.01)
*B21J 13/08* (2006.01)
(Continued)

(52) U.S. Cl.
CPC . *B21J 9/06* (2013.01); *B21J 7/14* (2013.01); *B21J 13/08* (2013.01); *B21J 13/02* (2013.01)

(58) Field of Classification Search
CPC . B22F 3/17; B21K 27/04; B21K 27/02; B21J 5/02; B21J 13/08; B21J 9/06;
(Continued)

(56) References Cited

U.S. PATENT DOCUMENTS 4,039,107 A * 8/1977 Boley ..... B21B 39/165
226/181
5,000,026 A * 3/1991 Pahnke ..... B21J 7/14
72/402
(Continued)

FOREIGN PATENT DOCUMENTS

CN 201603836 U * 10/2010
EP 2014390 A 1/2009
(Continued)

OTHER PUBLICATIONS

Machine translation from Korean Patent Information Online Network of Korean Patent application KR20100087642A (Reference No. 0140) to Shim is attached.*
(Continued)

*Primary Examiner* — Peter DungBa Vo
*Assistant Examiner* — John S Lowe
(74) *Attorney, Agent, or Firm* — Andrew Wilford

(57) ABSTRACT

The invention relates to a four-die press tool (1), comprising a lower die assembly (4) and an upper die assembly (6) displaceable relative thereto, comprising four rams (10, 11, 12, 13) spaced apart and supported on the lower die assembly (4) or the upper die assembly (6) and carrying forging dies (29), and a ring (20) on which are mounted the four rams (10, 11, 12, 13) concentrically around the central press axis (28) of the four-die press tool (1) in such a way that they can be displaced relative to the central press axis (28) whenever the upper die assembly (6) is moved relative to the lower die assembly (4), wherein protecting means (35) are mounted on the ring (20) to secure a workpiece in a centered position on a central predetermined position of the workpiece relative to the central press axis (28) independently of a workpiece manipulator.

12 Claims, 2 Drawing Sheets

(51) Int. Cl.
*B21J 13/02* (2006.01)
*B21J 7/14* (2006.01)

(58) Field of Classification Search
CPC ..... B21J 13/02; B21J 13/03; B21J 1/00; B21J 13/025; B21J 9/025; B21J 39/00–39/18; B21D 35/00
See application file for complete search history.

(56) References Cited

U.S. PATENT DOCUMENTS

| | | | | |
|---|---|---|---|---|
| 5,553,931 | A * | 9/1996 | Diekevers | B62D 55/15 305/100 |
| 2013/0247642 | A1* | 9/2013 | Lazorkin | B21J 13/025 72/360 |

FOREIGN PATENT DOCUMENTS

| | | | | |
|---|---|---|---|---|
| JP | 56033145 | A | * | 4/1981 |
| KR | 20120025327 | A | * | 3/2012 |
| RU | 2016692 | A | | 7/1994 |
| RU | 2018404 | A | | 8/1994 |
| RU | 2018404 | C1 | | 8/1994 |
| RU | 2446906 | C1 | | 4/2012 |
| UA | 66605 | A | | 5/2004 |

OTHER PUBLICATIONS

Machine translation of CN201603836U to unknown; dated Oct. 13, 2010 is attached.*
Korean Patent KR 20120025327 A to Shim, In Seob; date: Mar. 15, 2012 is attched.*
Chinese patent CN 201603836 U to unkown; date: Oct. 13, 2010 is attached.*

* cited by examiner

FOUR-DIE TOOL AND FORGING PRESS

FIELD OF THE INVENTION

The invention relates to a four-die press tool comprising a lower die assembly and an upper die assembly displaceable relative thereto, four rams spaced apart and supported on the lower die assembly or the upper die assembly and carrying respective forging dies, and a ring on which the four rams are mounted concentrically around the central press axis of the four-die press tool in such a way that they can be displaced relative to the central press axis whenever the upper die assembly is moved relative to the lower die assembly.

The invention furthermore relates to a forging press, in particular, an open-die forging press having a four-die press tool defining a central press axis for compressively deforming a workpiece into an elongated semifinished product or the like, and comprising at least one workpiece manipulator that feeds the workpiece to the four-die press tool.

BACKGROUND OF THE INVENTION

Forging presses are already well-known in the art, such as, for example, in RU 2 016 692.

Standard four-die forging units are in particular equipped with four actuators, typically including respective independent drives that in turn enable radial movement of the respective dies for forging with a motion that runs simultaneously perpendicular thereto by all four dies in one uniform tangential direction. The disadvantage of these types of four-die pressing units lies in the independence of the drive means for each die of the forging unit, since this then requires the four dies to be synchronized, thereby significantly complicating the construction of the four-die forging units. If the moment has not been determined with sufficient precision at which the four dies simultaneously contact the workpiece to be forged, it is possible for critical flattened areas and/or cracks to appear in this workpiece.

These disadvantages can be prevented by the four-die forging unit disclosed in RU 2 018 404 C1 that includes a pressure plate and a retaining plate having oblique surfaces on which retainers and four dies kinematically connected to the retainers are mounted, the dies being attached to and guided in the guides of the retainers in such a way that they can move in a transverse direction relative to the retainers. As a result, the dies are mounted in an X-configuration and can thus be displaced obliquely, that is, at an angle relative to the horizontal and vertical center planes when the pressure plate is displaced relative to the retaining plate. The retainers for the dies here are connected to each other kinematically through a box-shaped frame and have the ability to move within guide grooves therein. A fixed stop is attached to each retainer on one of its identically oriented lateral surfaces. The fixed stops interact with the laterals surfaces of the dies mounted on adjacent retainers when the four-die forging unit is in use. Each die is forced back to the starting position by an elastic element.

Publication EP 2 014 390 B1 also describes a similar four-die forging unit that is designed in an X-configuration with the object of achieving an extended repair-free service life due to the modified design.

OBJECT OF THE INVENTION

The object of the invention is therefore to develop prior-art forging presses, in particular, a four-die forging unit in such a way that their repair-free service life can be ensured to an even more reliable degree.

SUMMARY OF THE INVENTION

The object of the invention is achieved by a four-die press tool comprising a lower die assembly and an upper die assembly displaceable relative thereto, four rams spaced apart and supported on the lower die assembly or the upper die assembly and carrying respective forging dies, and a ring on which the four rams are mounted concentrically around the central press axis of the four-die press tool in such a way that they can be displaced relative to the central press axis whenever the upper die assembly is moved relative to the lower die assembly, wherein according to the invention protecting means are mounted on the ring in order to secure a central predetermined position of the workpiece relative to the center axis of the press independently of a workpiece manipulator.

The protecting means integrated in the four-die press tool provide a very simple way in terms of construction to virtually completely eliminate the danger of a workpiece to be compressed moving unintentionally into the functional area of moving functional parts, in particular, inside the ring, thereby creating a breakdown in the four-die press tool. The forging dies in the most extreme situations can be seriously damaged or even destroyed by a workpiece that slides off to a critical extent.

These protecting means thus essentially involve parts or elements forming a drop protector or fall guard by the four-die press tool itself.

The situation previously often arose in forging presses equipped with a four-die press tool whereby significant breakdowns repeatedly occur due to the fact that a workpiece to be forged had fallen between the dies or the rams of the four-die press tool, either accidentally or by operator error, from a workpiece manipulator, such as manipulator tongs or the like. Accidents of this type frequently result in costly and expensive repairs that furthermore also entail a relatively time-consuming stoppage of production.

This situation can be prevented, however, by the four-die press tool according to the invention, by means of which a significantly longer repair-free service life can be achieved for the four-die press tool, and thus also for a forging press equipped therewith.

In addition, the invention, despite the presence of the protecting means, still allows the workpiece manipulator, in particular, the manipulator tongs, to move directly up to the four-die press tool since the protecting means are integrated directly into the four-die press tool. This then enables operational reliability to be further enhanced in terms of the workpiece manipulator gripping the workpiece to be forged.

Accordingly, a further object of the invention is achieved by a forging press, in particular, an open-die forging press, comprising a four-die press tool defining a central press axis for the purpose of compressively deforming a workpiece into an elongated semifinished product or the like, and comprising at least one workpiece manipulator that feeds the workpiece to the four-die press tool, wherein the forging press is characterized by a four-die press tool having one of the features described here.

The four-die press tool that is equipped with these protecting means reliably ensures that a workpiece to be forged is reliably caught whenever it slides off and before it can reach between the forging dies or the rams of the four-die press tool. As a result, a repair-free operational life can be achieved thereby.

External guide devices between the four-die press tool and a workpiece manipulator can be advantageously eliminated since the workpiece to be forged can be guided reliably by these protecting means up to the forging dies.

This four-die press tool can be designed in various ways. The protecting means provided according to the invention can especially effectively implement their function in the form of a drop protector or fall guard if the rams are arranged in an X-configuration. This type of X-configuration enables the pressing forces to be utilized substantially more effectively than in four-die press tools in an +-configuration in which the rams are arranged spatially only with one horizontal or one vertical orientation component.

This possibility cannot be excluded, however, in the case of a four-die press tool. It is precluded here, however, by the protecting means attached to the retaining ring.

A wide variety of workpieces can be formed by the forging press according to the invention, such as, for example, bar material, billets, slabs, ingots, blooms, or the like, for example, into semifinished products, such as, for example, long forged products, etc.

It is of course understood that this forging press can be of quite varied type. The preferred implementation of the forging press according to the invention is as an open-die forging press. However, the forging press can also be advantageously implemented in the form of a radial forging press, moving cylinder press, moving frame press, moving crosshead cylinder press, or the like, to mention only a few specific examples.

The term "rams" within the meaning of the invention describes those parts to which the forging dies, that is, the actual forging tools, are attached, preferably replaceable ones, to the ends of the parts facing the central press axis.

It is of course understood that the protecting means according to the invention can also be of varied design. They are advantageously represented by parts that provide the drop protector or fall guard. These parts advantageously at least have a sufficiently large contact surface area in the region of the central press axis, on which surface the workpiece to be forged can be supported.

The protecting means should in any case be designed for workpiece weights of at least up to 3t.

In addition, the protecting means should be able to be adapted to different workpiece diameters.

The protecting means are advantageously designed so as to be able at the same time to effect centering of the workpiece to be forged. A centering means of this type for the workpiece that is attached directly to the retaining ring part is heretofore also unknown in a four-die press tool.

It should be emphasized here that it is extremely advantageous if the protecting means attached to the ring are able to track the motion of the ring without the need of an additional external guide device for this purpose to follow the motion of the ring by means of costly controlling and/or regulating mechanisms when the ring changes its position within the four-die press tool. This factor also enables operational reliability to be further improved.

It is thus advantageous for the protecting means to be mounted on or attached to the four-die press tool so as to be able to follow a motion of the ring.

In an especially preferred variant embodiment, the protecting means comprise at least one centering device including a centering roller by which the workpiece is centered relative to the central press axis independently of a workpiece manipulator. The workpiece to be forged can roll especially effectively over the centering roller of the centering device as it is being passed along the central press axis through the four-die press tool when it is being worked. This enables the workpiece to already be in mechanical contact with the appropriately equipped protecting means during forging, thereby allowing the drop height for the workpiece to preferably be completely eliminated in the event, for example, that the workpiece can no longer be held or guided appropriately by the workpiece manipulator.

Direct mechanical contact between the workpiece and the protecting means or the centering roller is especially advantageous for very heavy workpieces.

The protecting means are advantageously mounted on the ring along the central press axis either upstream of or downstream of the rams, that is upstream of or downstream of a forging area, which approach enables a two-point support to be provided as the protecting means for the workpiece to be forged. It is of course understood, however, that the protecting means can be provided either upstream of, or alternatively, downstream of the rams.

Since these protecting means are preferably employed only as a drop protector or fall guard, it is sufficient in terms of construction for the protecting means to be mounted in fixed fashion relative to the central press axis. Accordingly, these protecting means, or the corresponding centering roller, can be viewed as passive protecting means for forming a drop protector or fall guard—in contrast to an active workpiece manipulator or manipulator.

The four-die press tool is adapted to various workpiece diameters by adjusting or modifying the appropriate distance between the protecting means, or the relevant centering device, and the central press axis by simply swapping out the protecting means or the centering device.

It is of course understood that the protecting means can, however, be mounted so as to be displaceable on the ring in terms of their spatial position, in the event this is deemed useful.

It is furthermore advantageous for the protecting means to be located completely below the central press axis.

It is especially advantageous for the protecting means to be located above the lower rams. This allows the protecting means or the centering roller to be mounted on the four-die press tool so as to reliably prevent a situation whereby the workpiece can fall between the lower rams or the forging dies attached thereto.

The protecting means or the centering device can be integrated especially compactly into the four-die press tool by locating the protecting means between the lower die assembly and the upper die assembly.

Integration of the protecting means in the four-die press tool can be even further improved by creating space for at least one seat pocket on the retaining ring, into which pocket the frame of the protecting means is placed.

Ideally, the seat pocket is sufficiently wide to provide a sufficiently large installation width for a frame of the protecting means or the centering device.

The frame is preferably bolted onto the ring, although other attachment methods can also be provided, such as, for example, bonded joints.

The centering device, or its centering roller, can be constructed in different ways.

For example, a sufficiently large, and also movable, support area to support the workpiece to be forged on the four-die press tool can be provided by the centering roller of the centering device.

The centering roller can also provide excellent support for a workpiece to be forged not only downward but furthermore also laterally if the centering element includes a concave-shaped body of rotation.

It is especially advantageous for the centering device to comprise a frame including a centering roller mount that is fixed thereto but also removable. This construction enables the centering device to be easily adapted to different workpiece diameters.

It is furthermore advantageous if the centering roller includes a body of rotation, and includes in each case on the end faces of the body at least one sealing groove that is mounted concentrically about its rotational axis and that holds a metal seal ring. This enables the bearings of centering roller to be especially well protected against scale or the like.

An independently usable variant provides an approach whereby the forging dies are fixed to but removable from the rams. This enables friction losses to be prevented on the four-die press tool, thereby also enabling a longer repair-free operational life to be achieved for the four-die press tool. A prior-art four-die press tool can be advantageously developed solely by this aspect, and this combination of features is thus itself advantageous without the other features of the invention.

Another advantageous aspect that is independent of the other features of the invention is if the four-die press tool is fixed with its upper die assembly to a movable crossbeam of the forging press, since this enables a previously typical spring resetting device or the like to be eliminated on the four-die press tool, by which means the upper die assembly is previously forced back into its starting position after the forging operation. Elimination of the associated spring resetting device enables a longer repair-free operational life to be achieved for the four-die press tool.

The lower die assembly and the upper die assembly are identical in terms of their basic design. The difference between the two lies in the application of force.

The application of force in the forging press is effected here through a protective plate that is permanently fixed to a movable crossbeam or the like approximately at the center of the upper die assembly.

The upper die assembly should be designed to be as thick as possible in order to preclude as much as possible any bending. There should furthermore be no cuts, or the fewest cuts possible, in the region of the bending cross-section so as to reduce any critical notch effect.

As in all other forging tools as well, the lower die assembly of the four-die press tool is preferably attached to a forging table. In contrast to the upper die assembly, the flow of force is applied here over the entire surface width, with the result that the lower die assembly is significantly stiffer, thereby resulting in no bending, or only negligible bending of the lower die assembly.

Since the four-die press tool must be displaced by the transverse displacement means of the forging press, guides are incorporated at the front and the back of the bases of the dies of the lower die assembly and the upper die assembly and can be engaged by wedges of the four-die press tool.

In order to reduce contamination of the four-die press tool that accumulates during continuous operation, and to prevent any resulting contamination and/or damage to the sliding surfaces, the lower die assembly is beveled at the center front and back, with the result that accumulating scale cannot collect, or collect only to a noncritical degree, in the four-die press tool, but instead the scale or the like can drop away automatically.

Accordingly, another advantageous variant embodiment provides an approach whereby extensive oblique regions are provided, in particular, below the central press axis on the ring and/or the lower die assembly, on their sides facing the central press axis so as to ensure that scale is effectively removed away from the four-die press tool.

In general, what can be emphasized is that a workpiece to be forged by this four-die press tool has an outstanding ability to center itself during forging by the four-die press tool, thereby enabling the danger to be significantly reduced of having the four-die press tool destroyed by a falling workpiece.

These types of protecting means that can be located on the four-die press tool are unknown, and this type of precise securing action cannot be ensured, or cannot be ensured to the same degree, by external guide devices or the like.

A further advantage of this four-die press tool must be seen in the fact, for example, that it allows qualitatively high-value products to be forged on a standard open-die forging press since the dies can press the workpiece precisely from four sides simultaneously, thereby preventing any spreading of the workpiece.

BRIEF DESCRIPTION OF THE DRAWING

Additional features, effects, and advantages of this invention are explained below based on the attached drawing and following description which present and describe, by way of example, a four-die press tool comprising protecting means that are attached directly to the tool's ring in order to secure independently of a workpiece manipulator a central predetermined position of a workpiece relative to a central press axis defined by the four-die press tool. In the drawing.

SPECIFIC DESCRIPTION OF THE INVENTION

Figure 1:
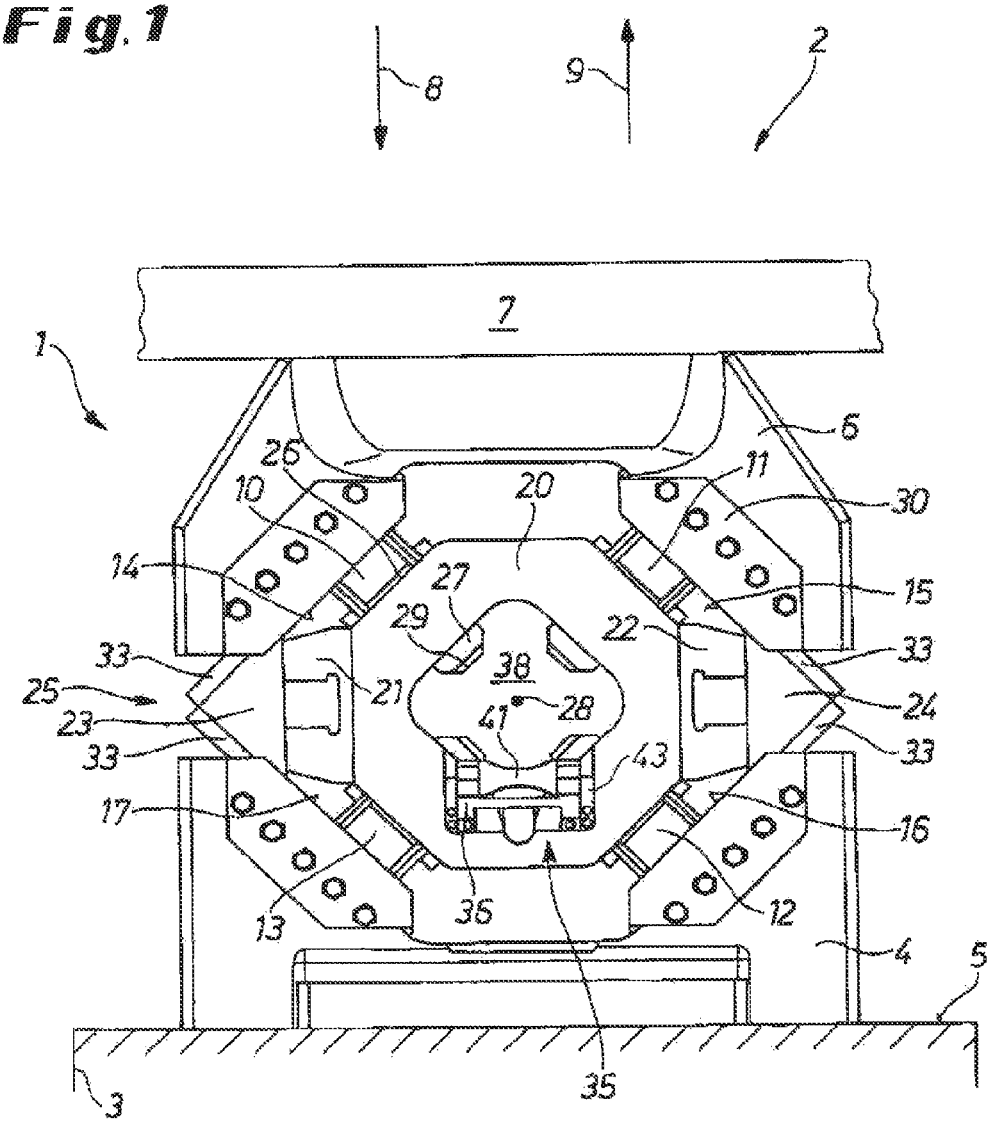
FIG. 1 is a schematic front view of a four-die press tool in an open-die forging press seen in the forging direction of a workpiece to be forged along the central press axis of the four-die press tool, where protecting means in the form of two centering devices equipped with centering rollers are mounted directly on a ring of the four-die press tool.
Figure 2:
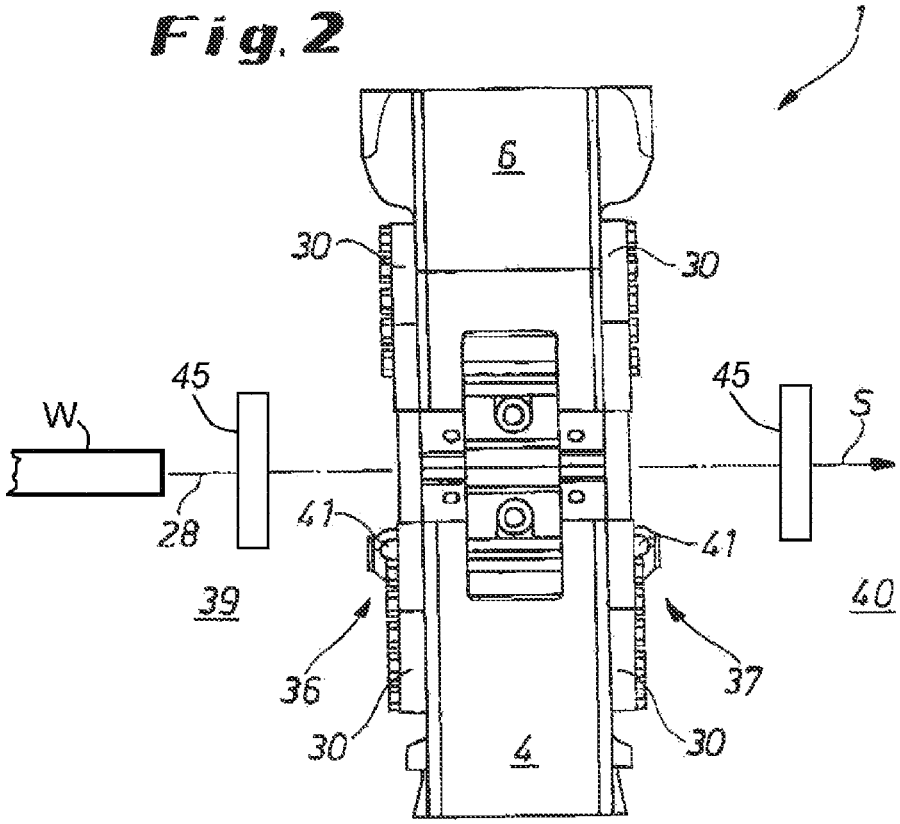
FIG. 2 is a schematic side view of the four-die press tool in FIG. 1.

As shown in FIGS. 1 and 2, a forging press 2 in the form of an open-die forging press 3 is provided with a four-die press tool 1.

The four-die press tool 1 includes a lower die assembly 4 fixed stationarily on a press table 5 of the forging press 2, as well as an upper die assembly 6 displaceable, that is movable relative to a lower die assembly 4, the upper die assembly being mounted fixed to a movable crossbeam 7 of the press 2.

The upper die assembly 6 of the four-die press tool 1 is fixed to the crossbeam 7 of the press 2 is such a way that the upper die assembly 6 can be moved in a vertical forward direction 8 downward toward the lower die assembly 4 not exclusively by the crossbeam 7 in order to perform a forging operation in the standard manner. In fact, the upper die assembly 7 can also then be actively moved by the crossbeam 7 also in a vertical rearward direction 9 upward and away from the lower die assembly 4, thereby enabling any associated resetting devices to be eliminated, such as those typically used in the prior art. An additional source of problems with the four-die press tool 1 is eliminated simply by doing away with these resetting devices, which problems can cause an overall malfunction of the press 2, thereby ensuring a cumulative or, alternatively, longer repair-free service life for the four-die press tool 1.

In addition, the four-die press tool 1 includes four rams 10, 11, 12, and 13 arranged in an X-configuration, of which the two upper rams 10 and 11 are each interactively connected to an upper 45° oblique element 14 and/or 15 of the lower die assembly 4, and of which the two lower rams 12 and 13 are each interactively connected to a lower 45° oblique element 16 and 17 of the upper die assembly 6. The vertical motions of the upper die assembly 6 are thus re-directed into four uniform individual motions of the rams 10, 11, 12, and 13.

In addition, the four-die press tool 1 includes a ring 20 that supports and guides the four rams 10, 11 12, and 13, the ring being suspended on two lateral supports 21 and 22 in the four-die press tool 1 between the lower die assembly 4 and the upper die assembly 6.

The supports 21 and 22 each have a wedge 23 and 24 each mounted so as to be movable on guides 25 (reference numeral here only by way of example) along the respective pairs of opposing 45° oblique elements 14 and 16, or 15 and 17 of the lower die assembly 4 and the upper die assembly 6. These wedges 23 and 24 are used, in particular, to compensate for vertical movements by the upper die assembly 6 of the four-die press tool 1 relative to the ring 20.

The ring 20 includes a retaining and guide bushing 26 (reference numeral only by way of example) for each of the four rams 10, 11, 12, and 13, by which bushing rams 10, 11, 12, and 13 are guided by the ring 20 such that the free ends 27 (reference numeral only by way of example) of four rams 10, 11, 12, and 13 are arrayed concentrically about a central press axis 28, along which a workpiece W to be forged is moved.

Actual forging dies 29 (also numbered only by way of example) that are used to forge the workpiece W are attached to free ends 27 of the rams 10, 11, 12, and 13 turned radially inward toward the central press axis 28, and are removably fixed so that they can be replaced.

No additional frictional sliding surfaces exist between the dies 29 and the corresponding mounts for this purpose at ends 27 of the rams 10, 11, 12, and 13 due to the fact that the dies are fixed. This enables any additional sources of friction to be excluded from the four-die press tool 1, and this factor too enables a cumulative or, alternatively, longer repair-free service life to be achieved for the four-die press tool 1.

Whenever the four-die press tool 1 is operating, the rams 10, 11, 12, and 13 are moved along a common line, specifically, the press axis 28, at the center of the ring 20 in order to appropriately work the workpiece W that is moved along the press axis 28. The return movement of the upper die assembly 6, as already described above is effected by the crossbeam 7 of the press 2, the four rams 10, 11, 12, and 13 and both wedges 23 and 24 being guided by clamping blocks 30 on the upper and lower die assemblies 4 and 6. As a result, the four rams 10, 11, 12, and 13, and both wedges 23 and 24 are returned to their starting position by the return movement 9 of the upper die assembly 6.

In particular, slide plates 33 are also mounted between the 45° oblique elements 14, 15, 16, and 17, and the respective lower and upper die assemblies 4 and 6, these plates being sacrificial wear parts. These slide plates 33 are preferably employed on the four-die press tool 1 wherever substantial wear can be expected, for example, due to the action of high forces.

According to the invention, means 35 are mounted on the ring 20 in order to center the workpiece W relative to the press axis 28 independently of any workpiece manipulator such as shown schematically at 45, this means 35 in this embodiment being specifically embodied as two centering devices 36 and 37 (see FIG. 2), of which the first centering device 36 is upstream in the forging direction S of the forging station in the ring 20, while the second centering device 37 is downstream of the forging station 38 in the ring 20. As a result, intermediate areas 39 and 40 are not obstructed between the four-die press tool 1 and workpiece manipulators 45 that are located and operate upstream or downstream of the press tool, by additional external guide devices (not shown), thereby enabling, for example, the workpiece manipulators 45 to move substantially closer to the four-die press tool 1 with the result that handling reliability can be significantly enhanced in terms of the workpiece W to be forged. An increase in handling reliability also results in a reduction in the danger of a workpiece W accidentally dropping between the two lower rams 12 or 13, thereby also enabling a longer repair-free service life to be achieved for the four-die press tool 1.

Each centering device 36 and 37 includes a rotating centering roller 41 (reference numeral only by way of example) that can rotate about a rotational axis mounted transversely relative to the forging direction.

In particular, the workpiece W can be centered by this centering roller 41 relative to the press axis 28 independently of one of the workpiece manipulators 45, thereby precluding the danger that the workpiece W can drop between the lower rams 12 and 13 if the workpiece W falls out of one of the workpiece manipulators 45.

The centering devices 36 and 37 are integrated especially compactly into the four-die press tool 1 since space is created here for appropriate seat pockets 43 (reference numeral only by way of example) in the form of recesses into which a frame 44 (see also FIG. 3) of each centering device 36 and 37 can fit.

Figure 3:
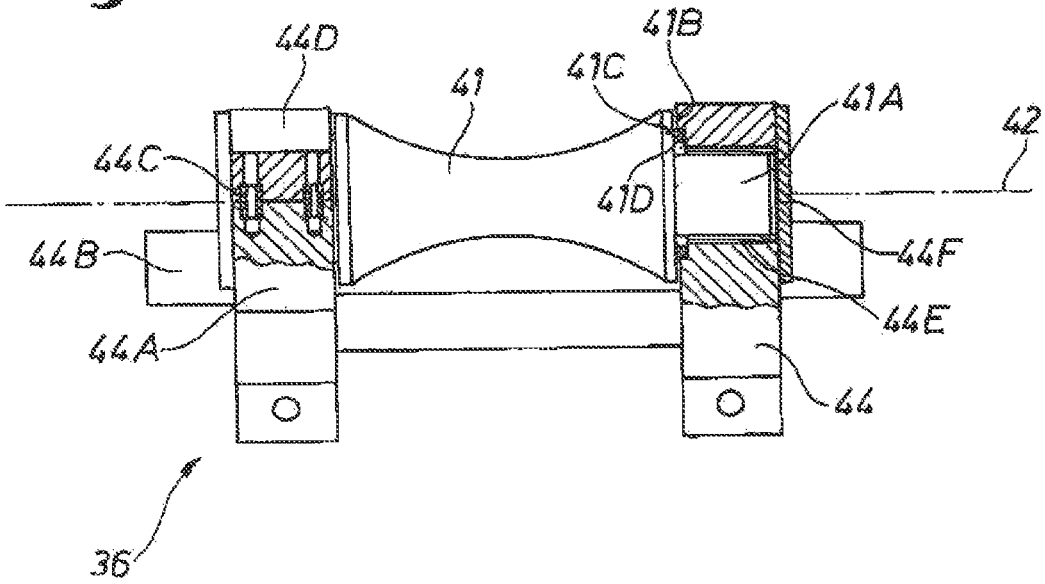
FIG. 3 is a schematic partial sectional detail of the centering devices in FIGS. 1 and 2.

A first embodiment of centering device 36 or 37 of protecting means 35 is shown by way of example in FIG. 3, and is described based on the upstream centering device 36 by way of example.

The centering device 36 in this embodiment cannot be adjusted in height relative to its connection point on the four-die press tool 1, that is, relative to the ring 20. The device 36 instead is immediately displaced by a motion of the ring 20, thereby significantly simplifying the construction of the centering device 36.

The device 36 is characterized, in particular, by a frame 44 that can be mounted on or removed from the ring 20 and that is a welded structure.

A centering roller mount 44A can be hooked into this frame 44 on mounts provided on the ring 20, not shown here, by lateral brackets 44B (reference numeral only by way of example), and furthermore preferably bolted permanently onto the ring 20 by two unillustrated bolts. One advantage of this type of attachment is its ease of maintenance. As a result, only the bolts have to be loosened to replace the centering roller 41. If the ingot diameter of the workpiece W to be forged varies, centering should be adapted to the respective initial height. This is done simply by replacing the centering roller 41. Eight locating bushings 44C (four locating bushings per side) are inserted in the centering roller mount 44A that ensure a precise fastening location for upper bearing parts 44D (reference numeral only by way of example).

The centering roller 41, which has the function of securing and guiding the workpiece W, is of concave shape and includes a shoulder 41A at its two ends (reference numeral only by way of example) that functions as a counter-rotation element for sliding ring elements 44E of centering roller mount 44A. In addition, sealing grooves 41C (reference numeral only by way of example) have been formed laterally into end faces 41B of the centering roller 41 to accommodate seal rings 41D so as to protect the bearings from accumulating contamination and scale. The bearings are further protected at the head end by covers 44F.

The main function of the ring 20 is to center the rams 10, 11, 12, and 13 along a common line or on the press axis 28 in order also to prevent any relative motion by the dies 29, that is, the actual tools, relative to the workpiece W to be forged. Without this ring 20, the rams 10, 11, 12, and 13 would be able to move freely within the four-die press tool 1, with the result that no synchronous movement would occur on the part of the rams 10, 11, 12, and 13 relative to each other. The four-die press tool 1 would not be able to function under these circumstances. The four-die press tool 1, however, also provides other advantages over previous four-die press tools. For example, it protects sliding surfaces of the lower and upper die assemblies 4 and 6, especially, however, those of the lower die assembly 4, from direct heat from the workpiece W to be forged, as well as from falling scale.

It must be explicitly emphasized here that the features of the solutions described above or described below can also be combined as required in order to implement or achieve the described features, effects, and advantages in corresponding cumulative fashion.

It is of course understood that the embodiment described above relates only to one first embodiment of the four-die press tool according to the invention. The embodiment of the invention is therefore not limited to this illustrated embodiment.

All of the features disclosed in the application documents are claimed as essential to the invention wherever they are new relative to the prior art, either individually or in combination.

The invention claimed is:

1. A four-die press tool adapted to be loaded by a manipulator with a workpiece, the tool comprising:

a lower die assembly and an upper die assembly displaceable relative thereto and flanking a central press axis;

four rams spaced apart and supported on the lower die assembly and the upper die assembly;

respective forging dies carried on the rams;

a ring on which the four rams are mounted concentrically around the central press axis of the four-die press tool in such a way that they can be displaced relative to the central press axis whenever the upper die assembly is moved relative to the lower die assembly; and protecting means on the ring, separate from and independent of the manipulator, and engageable with a workpiece for centering the workpiece in a predetermined position relative to the forging dies relative to the central press axis.

2. The four-die press tool according to claim 1, wherein the protecting means comprise a centering roller that centers the workpiece relative to the central press axis independently of the manipulator.

3. The four-die press tool according to claim 1, wherein the protecting means are mounted on the ring upstream and downstream of the rams along the central press axis.

4. The four-die press tool according to claim 1, wherein the protecting means are fixed relative to the central press axis.

5. The four-die press tool according to claim 1, wherein the protecting means are between the lower die assembly and the upper die assembly.

6. The four-die press tool according to claim 1, wherein at least one seat pocket is formed on the ring, a frame of the protecting means fitting in the pocket.

7. The four-die press tool according to claim 2, further comprising:

a frame including a mount for the centering roller, the mount being removably fixed to the frame.

8. The four-die press tool according to claim 2, wherein the centering roller includes a body of rotation and includes on each end of the body at least one sealing groove that is concentric to the rotational axis of the body and that holds a metal seal ring.

9. The four-die press tool according to claim 1, wherein the four-die press tool is fixed by its upper die assembly to a movable crossbeam of the forging press.

10. The four-die press tool according to claim 1, wherein the forging dies are mounted so as to be fixed on but removable from the respective rams.

11. The four-die press tool according to claim 1, wherein the rams are mounted in an X-configuration centered on the axis.

12. An open-die forging press comprising a four-die press tool defining a central press axis for compressing and deforming a workpiece into an elongated semifinished product, and comprising at least one workpiece manipulator to deliver the workpiece to the four-die press tool, characterized by a four-die press tool according to claim 1.

* * * * *